US009789626B2

(12) United States Patent
Clark

(10) Patent No.: US 9,789,626 B2
(45) Date of Patent: Oct. 17, 2017

(54) MACHINERY FENCE SUPPORT FACILITATING FENCE MOVEMENT IN A DIRECTION PERPENDICULAR TO A LENGTH OF THE FENCE

(71) Applicant: Kreg Enterprises, Inc., Huxley, IA (US)

(72) Inventor: Scott L. Clark, Boone, IA (US)

(73) Assignee: Kreg Enterprises, Inc., Huxley, IA (US)

( * ) Notice: Subject to any disclaimer, the term of this patent is extended or adjusted under 35 U.S.C. 154(b) by 656 days.

(21) Appl. No.: 14/480,677

(22) Filed: Sep. 9, 2014

(65) Prior Publication Data

US 2014/0373976 A1 Dec. 25, 2014

Related U.S. Application Data

(60) Division of application No. 13/089,426, filed on Apr. 19, 2011, now Pat. No. 9,056,402, which is a (Continued)

(51) Int. Cl.

| | |
|---|---|
| ***B23P 19/00*** | (2006.01) |
| ***B27C 5/04*** | (2006.01) |
| ***B27C 5/06*** | (2006.01) |
| ***B27F 1/04*** | (2006.01) |
| ***B27G 13/00*** | (2006.01) |
| ***B27G 13/12*** | (2006.01) |
| ***B27M 3/08*** | (2006.01) |

(Continued)

(52) U.S. Cl.

CPC ..... *B27C 5/04* (2013.01); *B27C 5/06* (2013.01); *B27F 1/04* (2013.01); *B27G 13/002* (2013.01); *B27G 13/12* (2013.01); *B27G 13/14* (2013.01); *B27M 3/08* (2013.01); *B27M 3/18* (2013.01)

(58) Field of Classification Search

CPC ..... B23P 11/00; B23P 11/005; B23P 15/00; B23P 19/00

See application file for complete search history.

(56) References Cited

U.S. PATENT DOCUMENTS 3,737,245 A 6/1973 Mater
5,097,555 A 3/1992 Dwyer
(Continued)

OTHER PUBLICATIONS

Website: Amana Tool® Constructing a Beaded Face Frame by Lonnie Bird, accessed Mar. 4, 2009, 2 pp., http://www.amanatool.com/articles/contructing_a_beaded_face_frame.htm.

(Continued)

*Primary Examiner* — Lee D Wilson

(74) *Attorney, Agent, or Firm* — Christopher A. Proskey; BrownWinick Law Firm

(57) ABSTRACT

In one example, a machinery fence support system comprises a worktable having a recess therein and a cutting element protruding upwardly from the worktable. The system has a track which is slidably received within the recess of the worktable. A bracket connected to the track; and a sacrificial fence is adjustably connected to the bracket. A track system is connected to the sacrificial fence and a stop assembly connected to the track system. The track slides within the recess of the worktable such that the sacrificial fence passes over the cutting element such that a beaded face frame feature is cut into a workpiece.

8 Claims, 17 Drawing Sheets

Related U.S. Application Data continuation-in-part of application No. 12/754,203, filed on Apr. 5, 2010, now Pat. No. 8,181,680.

(60) Provisional application No. 61/166,576, filed on Apr. 3, 2009.

(51) Int. Cl.
*B27M 3/18* (2006.01)
*B27G 13/14* (2006.01)

(56) References Cited

U.S. PATENT DOCUMENTS

| | | | | |
|---|---|---|---|---|
| 7,226,257 | B2 | 6/2007 | Lowder et al. | |
| 7,464,737 | B2 | 12/2008 | Duginske | |
| 7,543,661 | B2 | 6/2009 | Griffo et al. | |
| 7,591,616 | B1 | 9/2009 | Kerner | |
| 8,181,680 | B1 * | 5/2012 | Clark | B27C 5/04 144/241 |
| 9,056,402 | B2 * | 6/2015 | Clark | B27C 5/04 |
| 2009/0053002 | A1 | 2/2009 | Kirby | |
| 2011/0192497 | A1 * | 8/2011 | Clark | B27C 5/04 144/371 |
| 2014/0373976 | A1 * | 12/2014 | Clark | B27C 5/04 144/371 |

OTHER PUBLICATIONS

Website: Hoffman, Morso NLEH Series: Automatic Guillotine for Beaded Face Frames, accessed Mar. 4, 2009, 4 pp., http://www.hoffman-usa.com/htm/beaded_face_frames/morso_nleh.htm.
Website: Hoffman, Introduction to the Beaded Face Frame System, accessed Mar. 4, 2009, 2pp., http://www.hoffman-usa.com/htm/beaded_face_frames/intro_beaded_face_frames.htm.
Website: Woodweb, Jig for beaded faceframes: Photographs of a shop-built jib, Jun. 4, 2003, 4 pp., http://www.woodweb.com/knowledge_base/beaded_face_frame_fabrication.htm.
Website: Jessem Tool Company, New Product, Mite-R-Slide™, accessed Dec. 1, 2008, 2 pp., http://www.jessem.com/mite-r-slide.htm.
Website: Woodweb, Discussion: Beaded Face Frame Fabrication, Jan. 24, 2005, 6 pp., http://www.woodweb.com/knowledge_base/beaded_face_frame_fabrication.htm.

* cited by examiner

MACHINERY FENCE SUPPORT FACILITATING FENCE MOVEMENT IN A DIRECTION PERPENDICULAR TO A LENGTH OF THE FENCE

CROSS REFERENCE TO RELATED APPLICATIONS

This application is a divisional of U.S. Ser. No. 13/089,426filed Apr. 19, 2011 which is a continuation-in-part of U.S. Ser. No. 12/754,203 filed Apr. 5, 2010 (now U.S. Pat. No. 8,181,680 issued May 22, 2012), which is a continuation of U.S. Ser. No. 61/166,576 filed Apr. 3, 2009.

TECHNICAL FIELD

This disclosure relates to jigs or fixtures for positioning, aligning, guiding, and/or holding a workpiece during a cutting or shaping operation.

BACKGROUND

Beaded face frames are face frames including molded features along interior edges of the frame, such as edges around openings of the face frame. One technique to produce beaded face frames is to build face frames with square stock and then apply separate bead molding to interior edges of the completed face frame. This technique requires the ends of the each molding piece to be miter cut to exact lengths according to the length of the, corresponding edge of the face frame. The molding pieces may be secured to the face frames using nails, glue or both. If nails are used, nail holes are preferably filled and sanded after securing the molding to the face frame.

Alternatively, beaded stock can be used. However, assembling beaded stock pieces to create a beaded face frame requires precisely notching out the bead of a workpiece to receive abutting workpieces. In addition, the beads of the abutting workpieces must be miter cut to align with the beads of the workpiece including the corresponding notch.

SUMMARY

In general, this disclosure relates to techniques for notching a workpiece for a beaded face frame using a rotary bit. In particular techniques include using a rotary bit having a profile of notch suitable for a beaded face frame with a machinery fence support system including a linear motion mechanism that facilitates motion of the fence in a direction substantially perpendicular to a length of the fence In an example, a machinery fence support system comprises a base providing a substantially stationary position relative to a cutting tool; a moveable fence for guiding a workpiece relative to the cutting tool, and a linear motion mechanism between the base and the fence. The linear motion mechanism facilitates motion of the fence in a direction substantially perpendicular to a length of the fence.

In another example, a machinery fence support system comprises a worktable providing a substantially stationary support relative to a cutting tool, a track fixed to the worktable, a base adjustably mounted to the track, a fence configured to support a workpiece during a cutting operation, and a set of linear bearings between the base and the fence to facilitate motion of the fence in a direction substantially perpendicular to a length of the fence.

In another example, a rotary bit for cutting a workpiece for a beaded face frame comprises a shaft for securing the rotary bit, and a cutting element fixed to an end of the shaft, the cutting element having a symmetric trapezoidal profile. The side of the profile of the cutting element proximate to the shaft is longer than the distal side of the profile of the cutting element, and the profile of the cutting element corresponds to the shape of a notch in the workpiece for receiving an abutting workpiece.

In another example, a method of notching a workpiece for a beaded face frame comprises obtaining a machinery fence support system. The machinery fence support system comprises a worktable providing a substantially stationary support relative to a router, a track fixed to the worktable, a base adjustably mounted to the track, a moveable fence for guiding the workpiece relative to the router, and a linear motion mechanism between the base and the fence. The linear motion mechanism facilitates motion of the fence in a direction substantially perpendicular to a length of the fence. The method further comprises mounting a rotary bit for cutting the workpiece for the beaded face frame in the router, securing the workpiece to the fence, and using the linear motion mechanism to move the fence and the workpiece over the rotary bit to cut the notch in the workpiece.

The details of one or more examples of this disclosure are set forth in the accompanying drawings and the description below. Other features, objects, and advantages of this disclosure will be apparent from the description and drawings, and from the claims.

DETAILED DESCRIPTION

Figure 1:
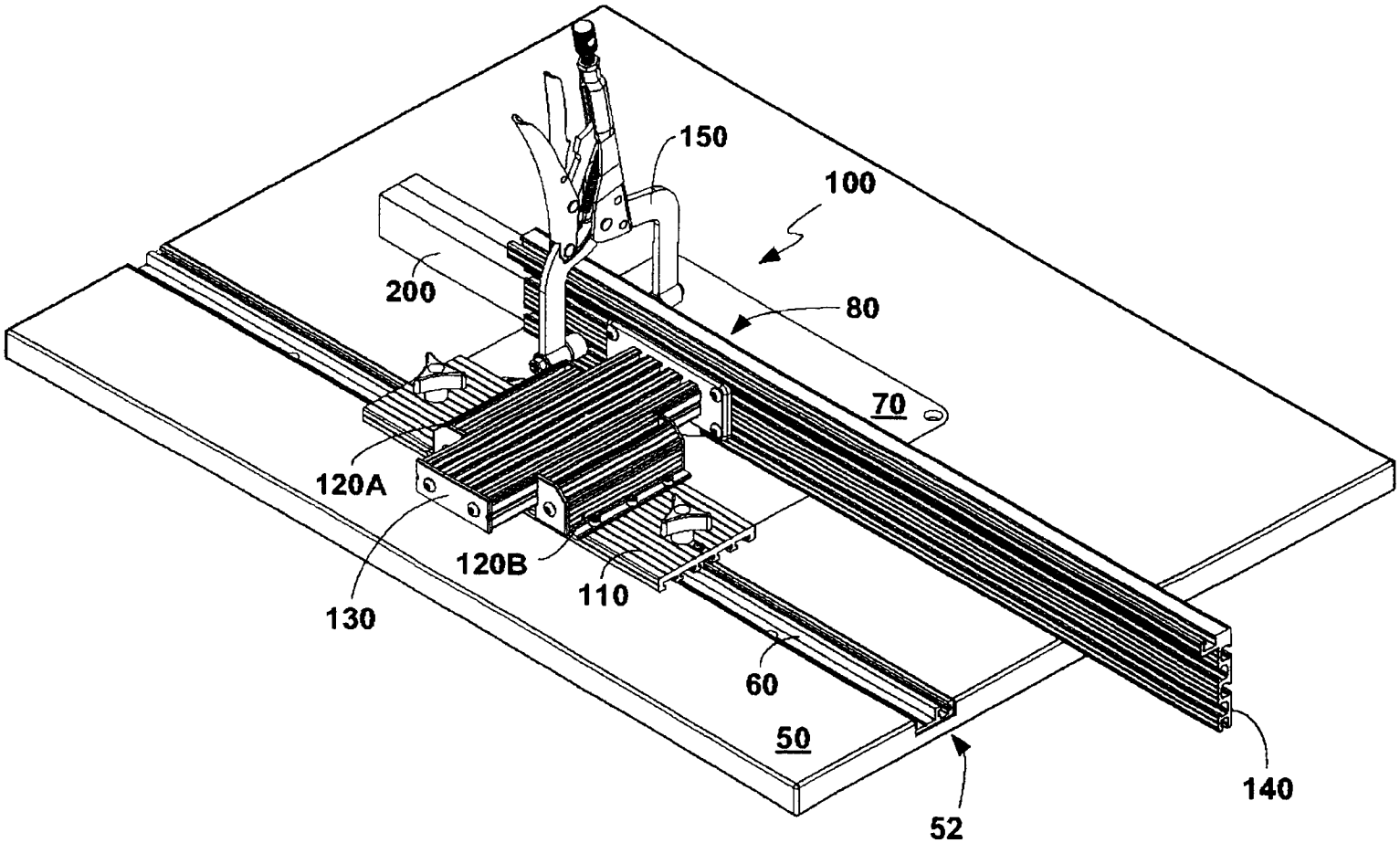
FIG. 1 illustrates an assembly including a worktable, a router and a machinery fence support system.
Figure 2:
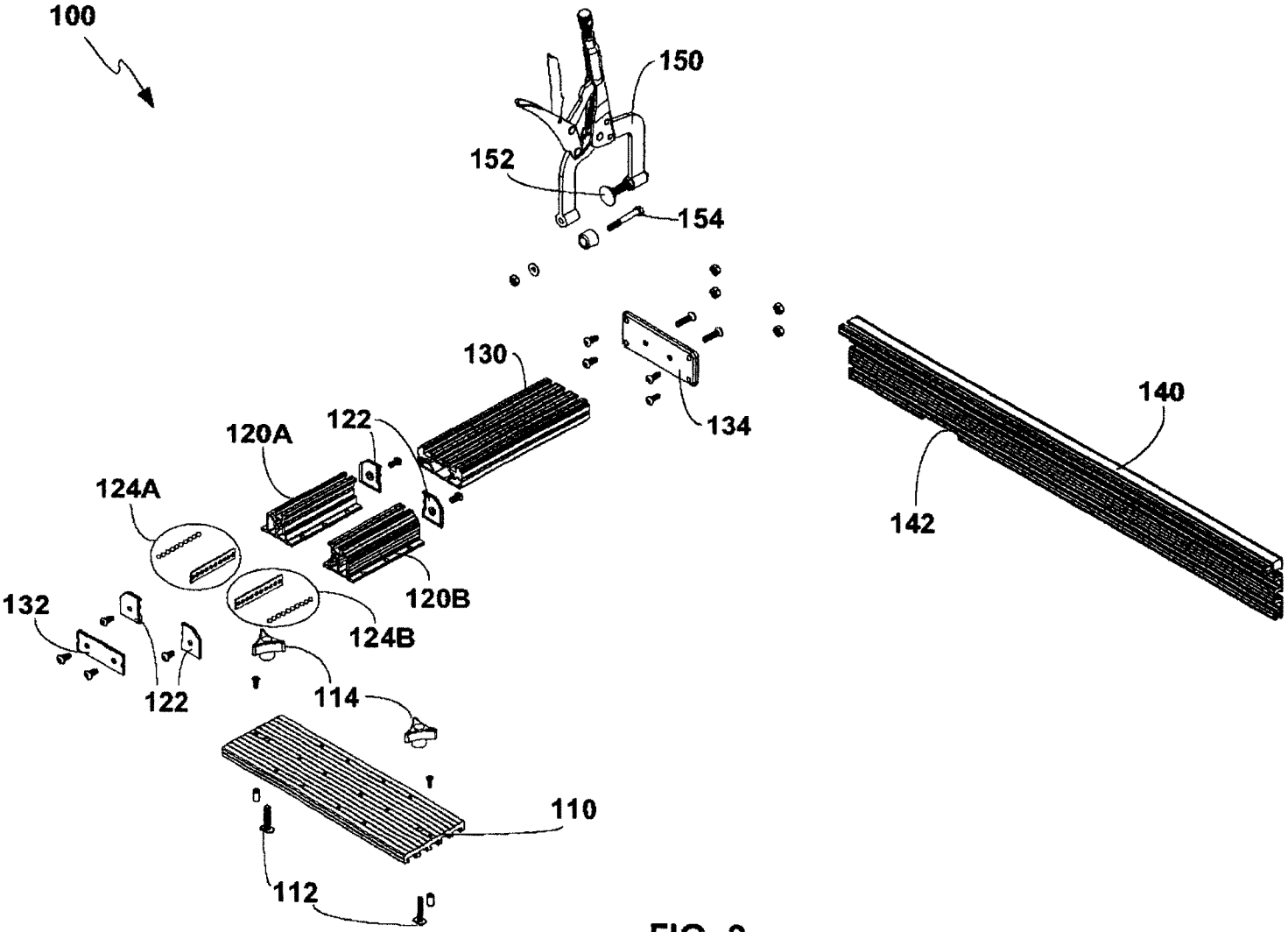
FIG. 2 is an exploded view of the machinery fence support system shown in FIG. 1.
Figure 3:
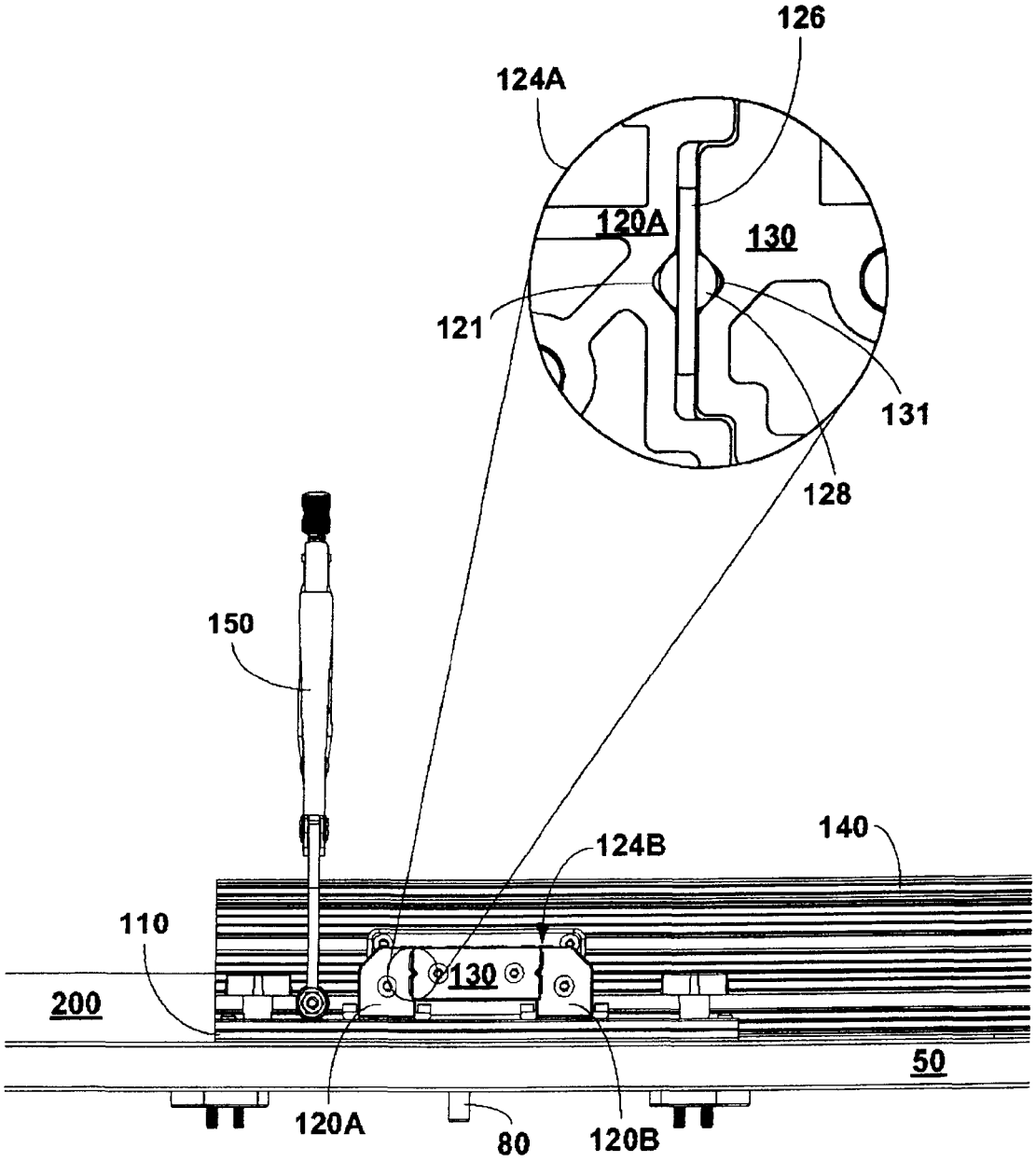
FIG. 3 is a side view of the machinery fence support system shown in FIGS. 1-2, and includes a close-up view illustrating a linear bearing of the machinery fence support system.

FIG. 1 illustrates an assembly including worktable 50, a router including rotary bit 80, and machinery fence support system 100. Machinery fence support system 100 includes base 110, stationary bearing supports 120A, 120B (collectively "stationary bearing supports 120") and moveable bearing support 130, fence 140 and clamp 150. FIG. 2 illustrates an exploded view of machinery fence support system 100. In addition, FIG. 3 illustrates a side view of the machinery fence support system 100.

Worktable 50 includes recess 52. Track 60 is securely mounted within recess 52 such that the top surface of track. 60 is no higher than the work surface of worktable 50. Worktable 50 also includes insert plate 70, which may be suitable to provide precisely flat and level worksurface adjacent to rotatable bit 80. In addition, insert plate 70 is removable and facilitates access to the router mounted below worktable 50.

Fence 140 is configured to support workpiece 200 during a cutting operation using rotatable bit 80. Clamp 150 is secured to fence 140 opposite a workpiece support surface of fence 140 via bolt 154. Bolt 154 allows the position of clamp 150 relative to fence 140 to be adjusted. Clamp 150 includes a clamping face 152 (FIG. 2). As shown in FIG. 1, workpiëce 200 is compressibly secured between clamping face 152 and the workpiece support surface offence 140.

Fence 140 is moveably secured to worktable 50 via base 110. As best illustrated in FIG. 2, base 110 is adjustably mounted to track 60 using T-bolts 112 and thumb screws 114. Other fixation mechanisms may also be used. As one example, hand-actuated cam mechanisms could be used to secure base 110 to track 60 instead of thumb screws 114. Preferably, base 110 is positioned such that recess 142 (FIG. 2) lines up with rotary bit 80 when fence 140 is actuated. In this manner, recess 142 is configured to allow fence 140 to pass over rotary bit 80 without contact between fence 140 and rotary bit 80.

Linear bearings 124 facilitate motion offence 140 in a direction substantially perpendicular to a length offence 140. Linear bearings 124 each include a set of ball bearings as well as a guide plate including a hole for each ball bearing in the set to hold the corresponding ball bearing in place relative to the guide plate (best shown in FIG. 2). The ball bearings interface between stationary bearing supports 120A, 120B (collectively "stationary bearing supports 120") and moveable bearing support 130. This relationship is best shown in FIG. 3, which illustrates in the close-up view of linear bearing 124A. In linear bearing 124A, guide plate 126 holds bearing 128 in place between stationary bearing support 120A and moveable bearing support 130. As also visible in the close-up view of linear bearing 124A, stationary bearing support 120A includes a groove 121 with two bearing support surfaces, and moveable bearing support 130 includes a groove 131 with two additional bearing support surfaces. For example, grooves 121, 131 may each be approximately right-angled grooves. The ball bearings in linear bearings 124 are each operable to simultaneously contact one of the bearing support surfaces on each of grooves 121, 131 such that linear bearings 124 facilitate a smooth and precise linear motion of moveable bearing support 130 and fence 140 relative to stationary bearing supports 120, base 110 and worktable 50.

Stationary bearing supports 120 each include two end caps 122 to hold the guide plates of linear bearings 124 in place. Likewise, moveable bearing support 130 includes end cap 132, which prevents moveable bearing support 130 from traveling off one end of stationary bearing supports 120 such that any of the ball bearings of linear bearings 124 could fall out. On the other end of moveable bearing support 130, opposite end cap 132, mounting plate 134 performs the dual function of securing fence 140 to moveable bearing support 130 and as well as preventing the over travel of moveable bearing support 130 in the other direction.

The two linear bearings 124 combine to substantially limit the motion of moveable bearing support 130 and fence 140 relative to stationary bearing supports 120 and base 110 along a straight line. For example, the configuration of the linear bearings 124 and the width of moveable bearing support 130, i.e., the distance between linear bearing 124A and linear bearing 124B, allows moveable bearing support 130 to be tightly constrained rather than being able to wiggle relative to base 110. This is important because if fence 140 were instead allowed to move in any significant amount in a direction that was not perpendicular to its length, the location of a notch cut in workpiece 200 by rotatable bit 80 would not necessarily be accurate. In addition, the notch itself would not necessarily match the profile of rotatable bit 80. As will be discussed in greater detail below, these features are important for cutting the precise notch necessary for a beaded face frame.

Linear bearings 124 constitute a linear motion mechanism. Other examples may include a different linear motion mechanism to facilitate motion offence 140 in a direction substantially perpendicular to a length of 140. For example, such examples may include linear motion mechanisms requiring manual actuation like linear bearings 124, while other examples may include mechanically powered linear actuators. Examples of suitable linear motion mechanisms include mechanical actuators, hydraulic pistons, pneumatic pistons, four-bar linkage assemblies, a single linear bearing, recirculating ball slide bearings, a track system with a rolling carriage, any combination of these mechanisms, or a different linear motion mechanism. Other techniques suitable for providing linear motion include linear shafting with polymer or bronze type bearings.

Optionally, machinery fence support system 100 may also include an adjustable stop (not shown) mounted to fence 140 to facilitate precise positioning of workpiece 200 as is necessary to produce an accurately positioned notch in workpiece 200 suitable for building a beaded face frame. As examples, the adjustable stop may be a flip-stop and/or include an indicator that interacts with a ruler on fence 140 to indicate a position of the stop relative to fence 140. Stops suitable for use in conjunction with fence 140 are disclosed in U.S. Pat. No. 7,464,737, titled, "WOODWORKING MACHINERY STOP AND TRACK SYSTEM," the entire content of which is incorporated herein by reference.

While machinery fence support system 100 has been described as facilitating motion offence 140 in a direction perpendicular to a length offence 140, machinery fence support system 100 may optionally include a rotatable coupling mechanism between fence 140 and the linear motion mechanism. Such a rotatable coupling mechanism would combine with the linear motion mechanism to facilitate motion offence 140 in multiple directions relative to the length offence 140. This would allow angled notches with the profile of rotatable bit 80 to be cut in workpiece 200. In contrast, machinery fence support system 100 as shown in FIG. 1 only allows notches with the profile of rotatable bit 80 to be cut square in workpiece 200. Such a rotatable coupling mechanism may be adjustable to any desired angle and/or include positive stops corresponding to define dangles relative to the length of the fence.

Figure 4:
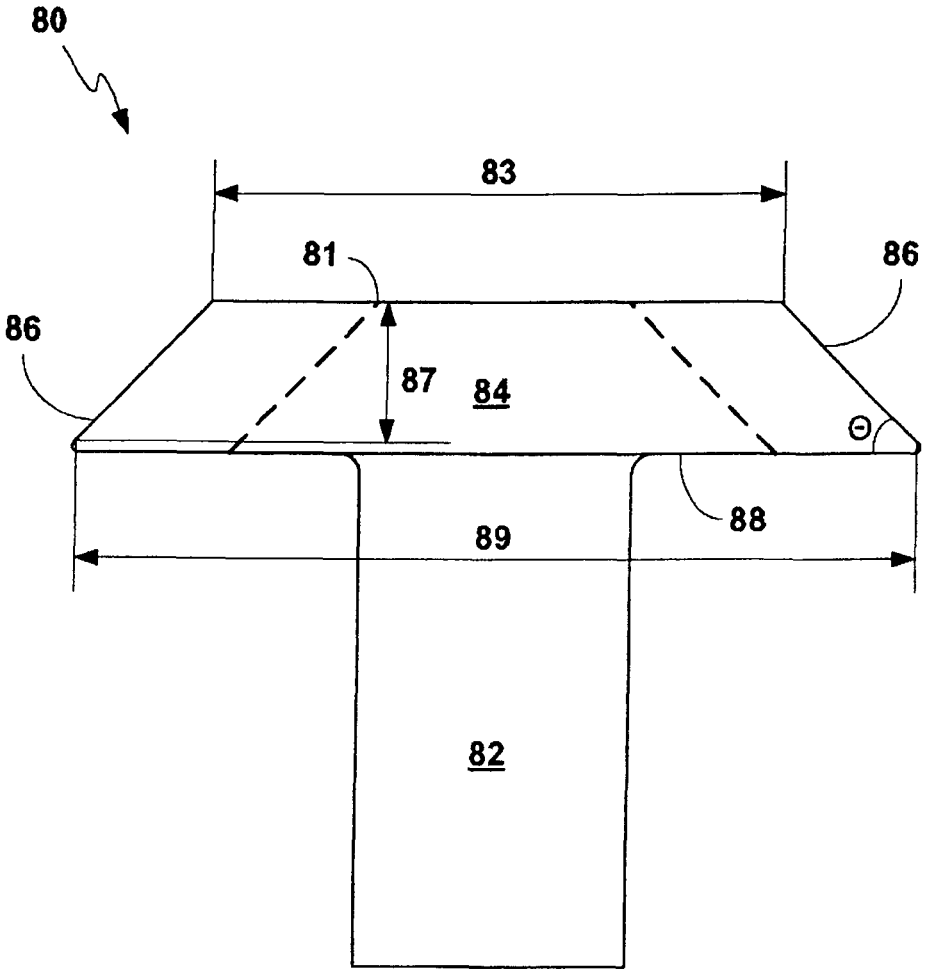
FIG. 4 illustrates a rotary bit for cutting a workpiece for a beaded face frame suitable for use in the machinery fence support system shown in FIGS. 1-3.

FIG. 4 illustrates a profile of rotary bit 80. Rotary bit 80 is suitable for cutting a workpiece for a beaded face frame. Rotary bit 80 includes shaft 82 and cutting element 84. Cutting element 84 has symmetric trapezoidal profile. The profile of cutting element 84 includes a cutting edge 86, distal side 81, which is distal relative to shaft 82 and proximate side 88, which is adjacent to shaft 82. The profile of cutting element 84 corresponds to the shape of a notch in a workpiece for receiving an abutting workpiece in a beaded face frame. For such an application, angle θ, the angle between proximate side 88 and cutting edge 86 is generally about forty-five degrees, but other angles may also be used, e.g., to build face frames with pieces that meet at angles different than ninety degrees.

Distal side 81 has a length 83. As an example, length 83 may be approximately equal to a width of a workpiece abutting a notch cut by rotary bit 80 in a beaded face frame, not including a width of beaded features along an edge of the abutting workpiece. As an example, length 83 may exceed 0.75 inches. As other examples, length 83 may exceed 1.0 inches, 1.5 inches, 2.0 inches, 2.5 inches or even 3.0 inches. For example, length 83 may be about 0.75 inches, 1.0 inches, 1.5 inches, 2.0 inches, 2.5 inches, 3.0 inches or 3.25 inches.

Proximate side 88 has a length 83. As an example, length 89 may be equal to or greater than the width of the abutting workpiece in a beaded face frame. As an example, length 89 may exceed 1.0 inches. As other examples length 89 may exceed 1.5 inches, 2.0 inches, 2.5 inches, 3.0 inches or even 3.5 inches. For example, length 89 may be about 1.0 inches, 1.5 inches, 2.0 inches, 2.5 inches, 3.0 inches, 3.5 inches or 3.75 inches.

Height 87 of cutting element is at least as high as the width of beaded features along an edge of a workpiece. As an example, height 87 may be between 0 and 2 inches. As other examples, height 87 maybe approximately 0.125 inches, 0.25 inches, 0.375 inches, 0.5 inches, 0.75 inches, 1.0 inch: 1.5 inches, 2.0 inches or another height. As discussed in greater detail with respect to FIG. 10, height 87 may be substantially similar to the width of a bead feature of a workpiece.

Figure 5C:
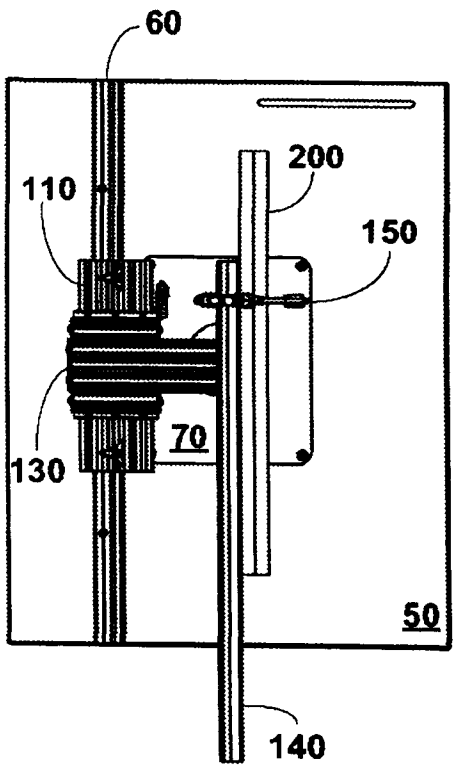
FIGS. 5A-5C are top views of the assembly of FIG. I and illustrate a cutting operation to notch a workpiece for a beaded face frame.
Figure 5B:
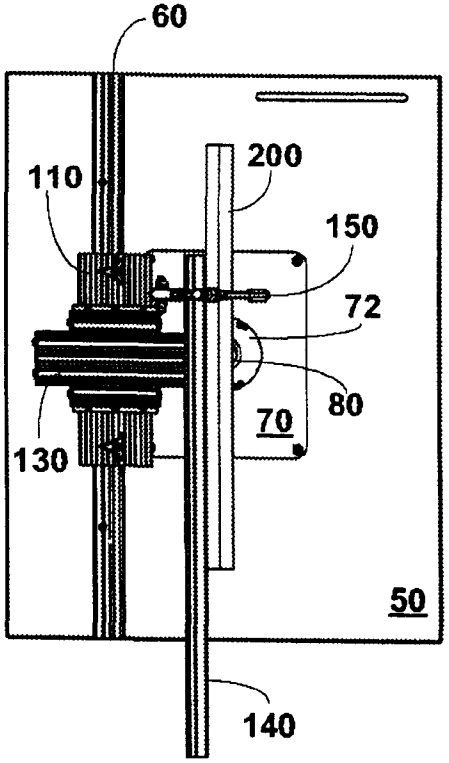
Figure 5A:
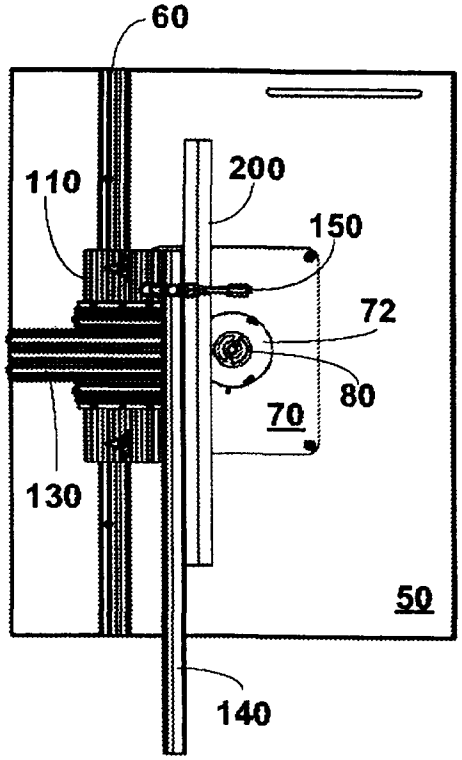

FIGS. 5A-5C are top views of the assembly of FIG. 1 and illustrate a cutting operation to notch workpiece 200 in a manner suitable for a beaded face frame. Worktable 50 provides a worksurface for the cutting operation. Insert plate 70 is mounted flush to worktable 50. Insert plate 70 includes a removable ring 72. Rotary bit 80 is mounted to a router below worktable 50 and protrudes from an aperture at the center of removable ring 72.

Base 110 is mounted to track 60. Fence 140 is secured to base 110 via moveable bearing support 130 and a linear motion mechanism as previously described herein.

As shown in FIG. 5A, workpiece 200 is secured to fence 140 with clamp 150. An operator (not shown) begins a cutting stroke by pushing fence 140, moveable bearing support 130 and workpiece 200 towards rotary bit 80 (FIG. 5B). As shown in FIG. 5C, the operator continues the cutting stroke until all of workpiece 200 has passed over rotary bit 80 such that a notch having the profile of the cutting element rotary bit 80 is cut into workpiece 200.

While not directly shown in FIGS. 5A-5C, cutting a notch into workpiece 200 for a beaded face frame also includes precisely positioning base 110 in track 60 as well as precisely positioning workpiece 200 relative to fence 140. For example, precisely positioning base 110 in track 60 may comprise zeroing the position offence 140 relative to the axis of rotation of the router. For example, fence 140 may include a ruler, and base 110 may be positioned in track 60 such that the zero (0) position of the ruler lines up with the axis of rotation of the router. In addition, a stop may be mounted at a precise position along fence 140 corresponding to a desired position of the notch using the ruler and an indicator on the stop.

In addition, rotary bit 80 may be set to a desired height prior to a cutting operation. As an example, the height of the rotary bit relative to worktable 50 may be about equal to a width of beaded features along an edge of workpiece 200. Indeed, the height of the rotary bit relative to worktable 50 should be precisely equal to a width of beaded features along an edge of workpiece 200, e.g., the height of the rotary bit relative to worktable 50 may be within 0.005 inches or even within 0.001 inches of the width of beaded features along an edge of workpiece 200 to facilitate precise alignment of workpiece 200 with other workpieces used to build a face frame.

Furthermore, the assembly of FIG. 1 may be used to make mitered cuts to the beaded features on the ends of a workpiece. For such an operation, a workpiece such as workpiece 200 is securely positioned relative to fence 140 such that the end of workpiece 200 only passes over cutting edge 86 (FIG. 4) of rotary bit 80 and not over distal side 81 (FIG. 4) of rotary bit 80. For example, an additional stop may be secured to fence 140 for precisely positioning for mitered cuts to the beaded features on the ends of a workpiece without having to adjust the position of stop(s) used to precisely position the workpiece for cutting the notches.

Figure 6:
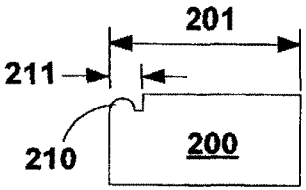
FIG. 6 illustrates a cross section of a workpiece having a bead.

FIG. 6 illustrates a cross section of workpiece 200, which includes bead 210. As shown in FIG. 6, workpiece 200 has a width 201, whereas bead 210 has a width 211.

Figure 7A:
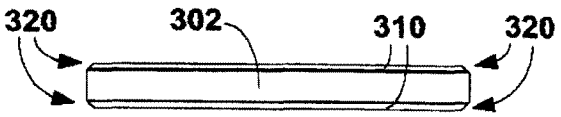
FIGS. 7A-7C illustrate a rail for a beaded face frame.
Figure 7B:
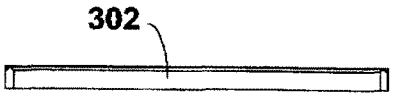
Figure 7C:
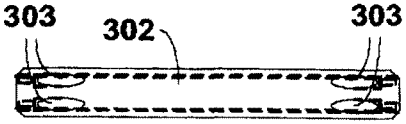

FIGS. 7A-7C illustrate top, side and bottom views respectively of center rail 302 for a beaded face frame. Rail 302 includes two beads 310. In contrast, top and bottom rails 306 (FIG. 9) only include a single bead. Mitered cuts 320 are located on the ends of beads 310. Mitered cuts 320 can be cut into a workpiece as discussed with respect to FIGS. 5A-5C.

Figure 9:
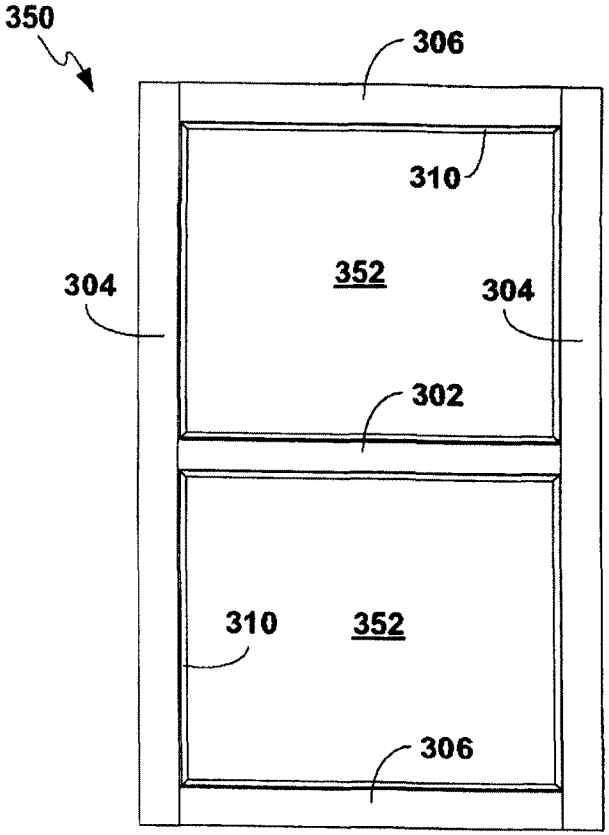
FIG. 9 illustrates an assembled beaded face frame including three rails and two stiles.

Rail 302 includes pocket holes 303, which may be used for fastening rail 302 to stiles 304 (FIG. 9) in beaded face frame 350 (FIG. 9). Other techniques for joining rail 302 to stiles 304 may also be used. These techniques include doweling, gluing, nailing, screwing, stapling, other suitable joining technique or any combination thereof.

Figure 8:
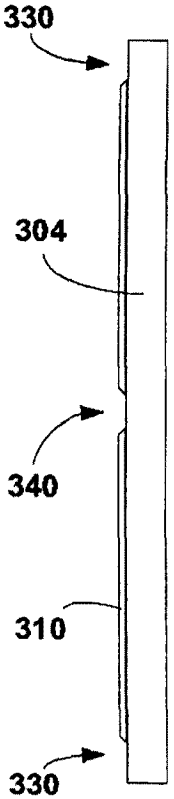
FIG. 8 illustrates a stile for a beaded face frame.

FIG. 8 illustrates stile 304 for a beaded face frame. Stile 304 includes a single bead 310. Partial notches 330 are located on the ends of bead 310, whereas full notch 340 is located in the center of bead 310. Partial notches 330 and full notch 340 can be cut into a workpiece as discussed with respect to FIGS. 5A-5C. For example, full notch 340 has the shape of the full profile of the top of rotary bit 80, whereas the shape of partial notches 330 only include a portion of the profile of the top of rotary bit 80.

FIG. 9 illustrates assembled beaded face frame 350. Assembled beaded face frame 350 includes center rail 302, top and bottom rails 306 and stiles 304. Rails 302, 306 are configured to mate with stiles 304 such that bead 310 forms a continuous loop around apertures 352 in beaded face frame 350. Specifically, partial notches 330 and full notch 340 in stiles 304 are configured to mate with the ends of rails 302, 306 including mitered cuts 320. Thus, beaded face frame 350 provides an aesthetically-pleasing finished look suitable for cabinetry and other applications.

Figure 10:
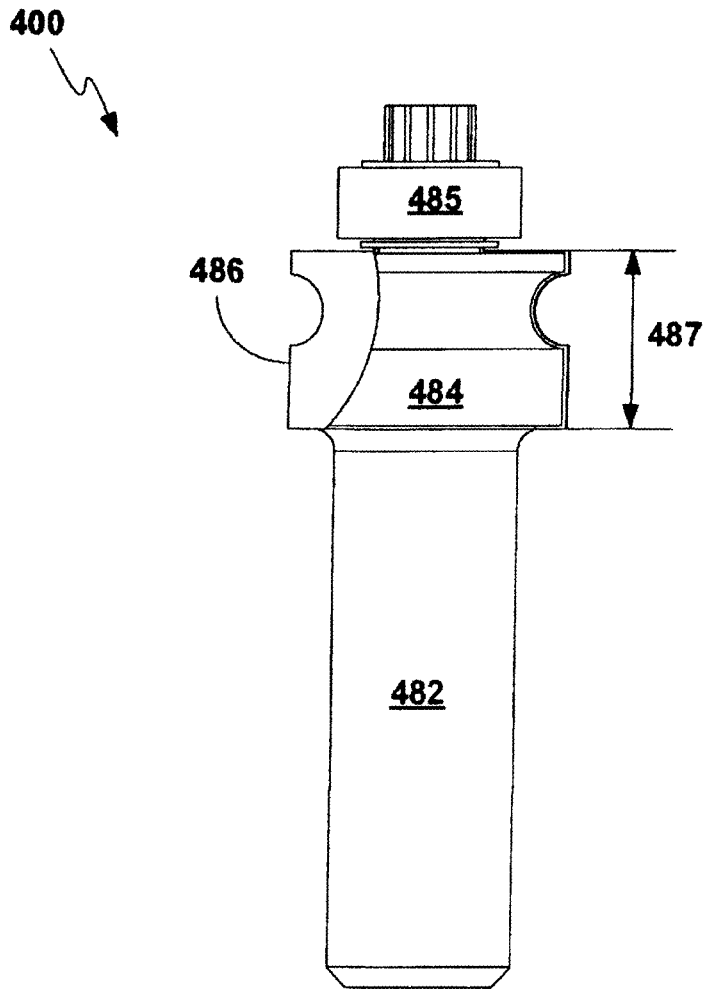
FIG. 10 illustrates an exemplary router bit for cutting beaded features along an edge of a workpiece.
Figure 11:
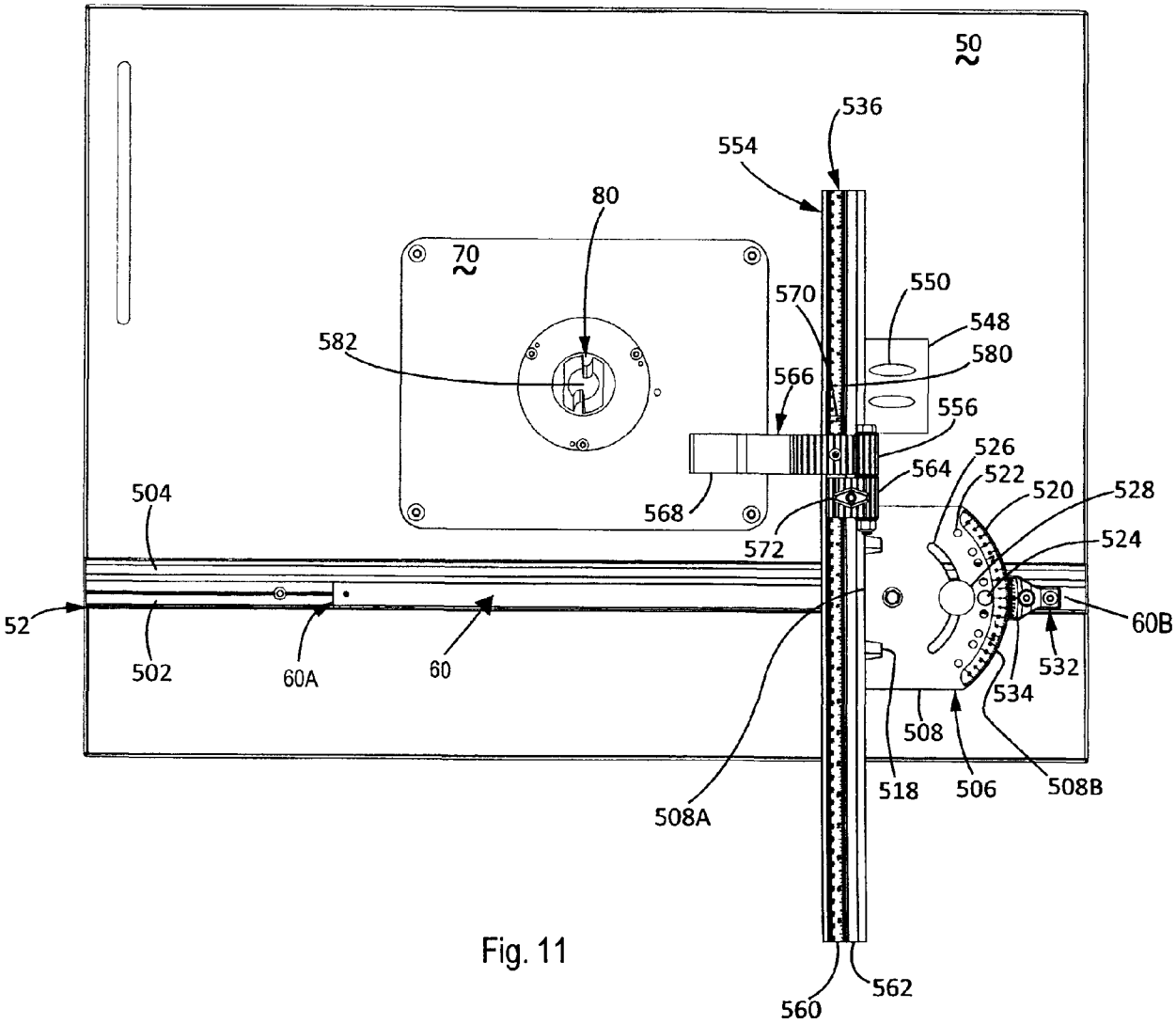
FIG. 11 is a top view of a modified machinery fence support system.
Figure 12:
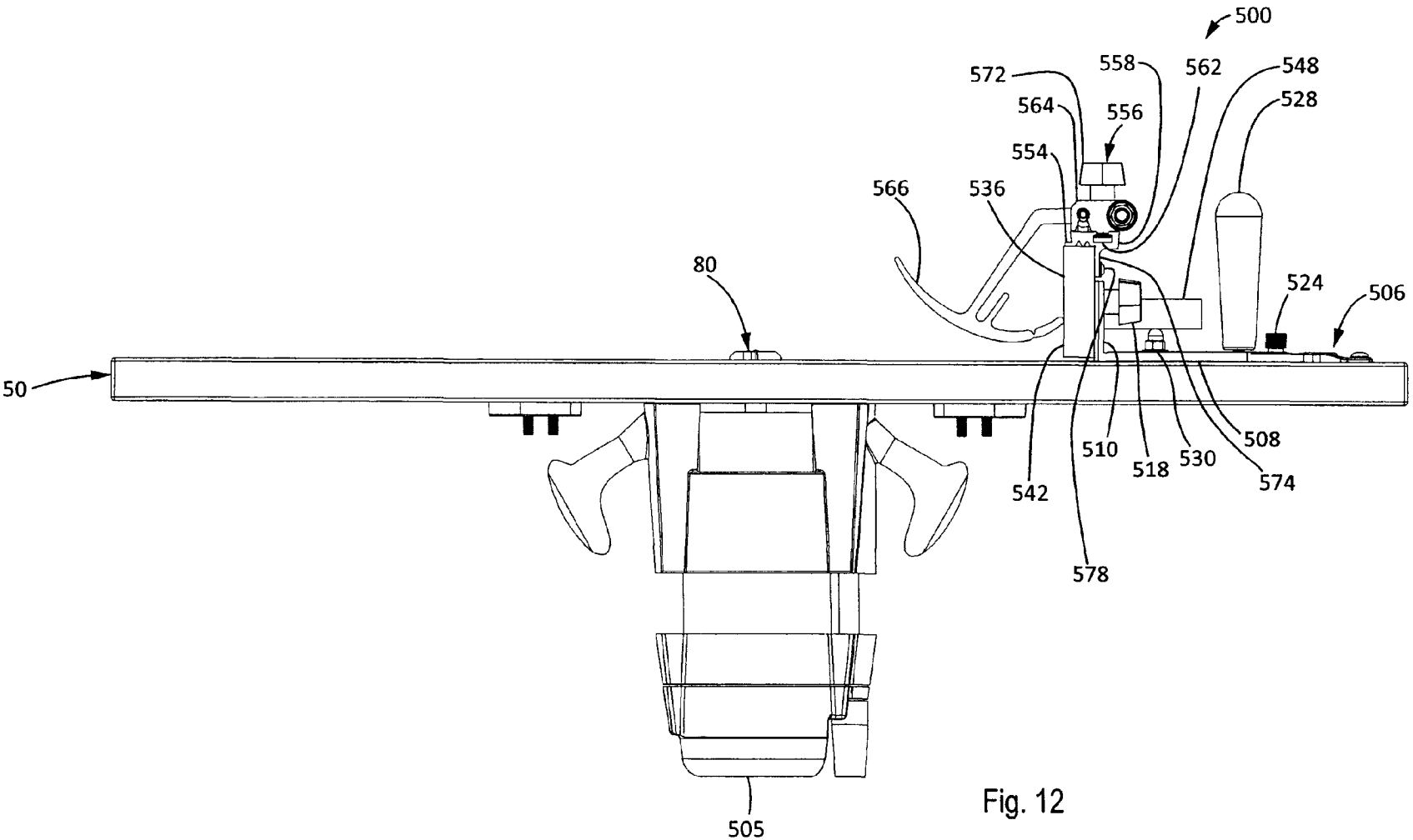
FIG. 12 is a side view of a modified machinery fence support system.
Figure 13:
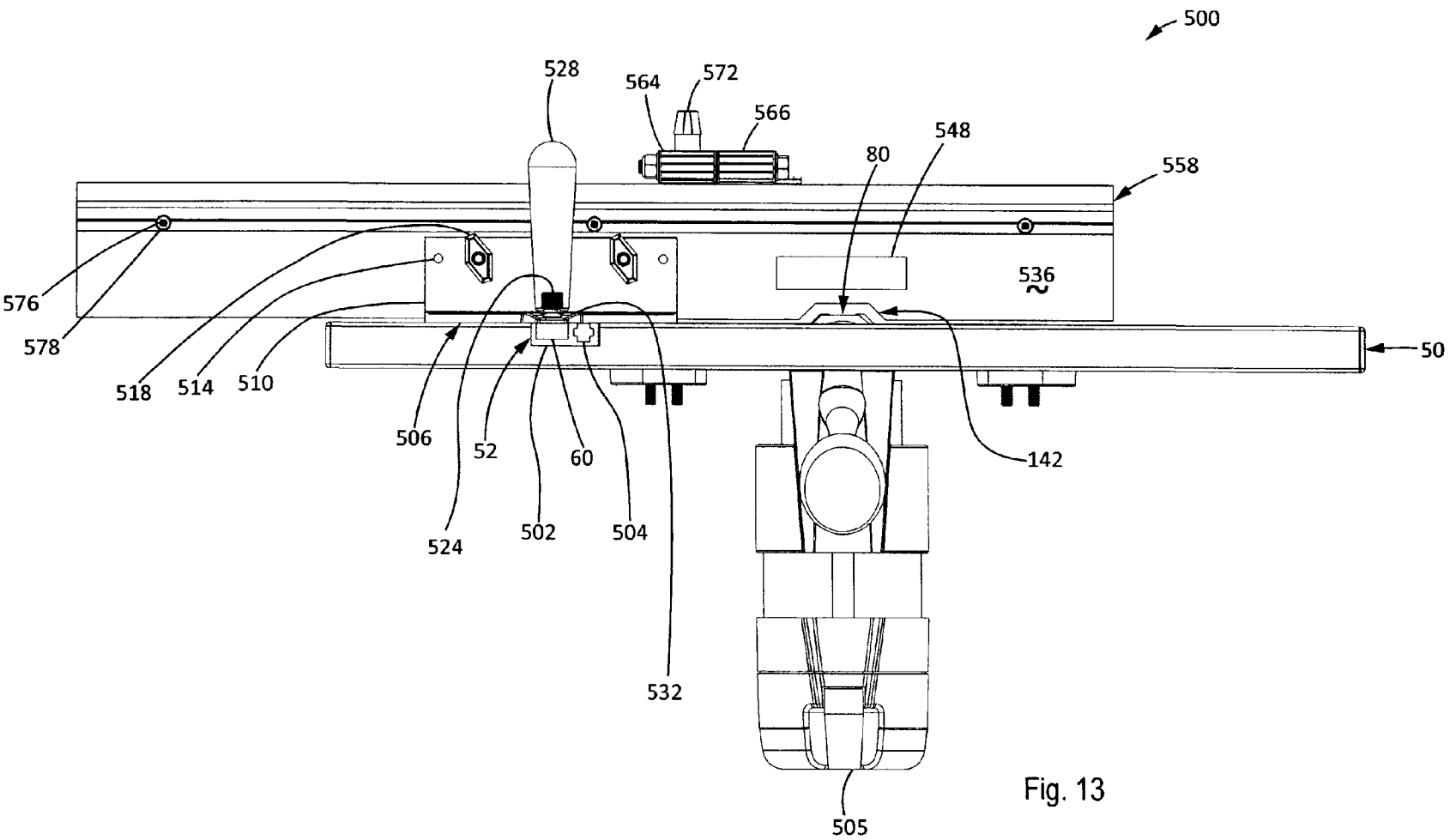
FIG. 13 is a side view of a modified machinery fence support system.
Figure 14:
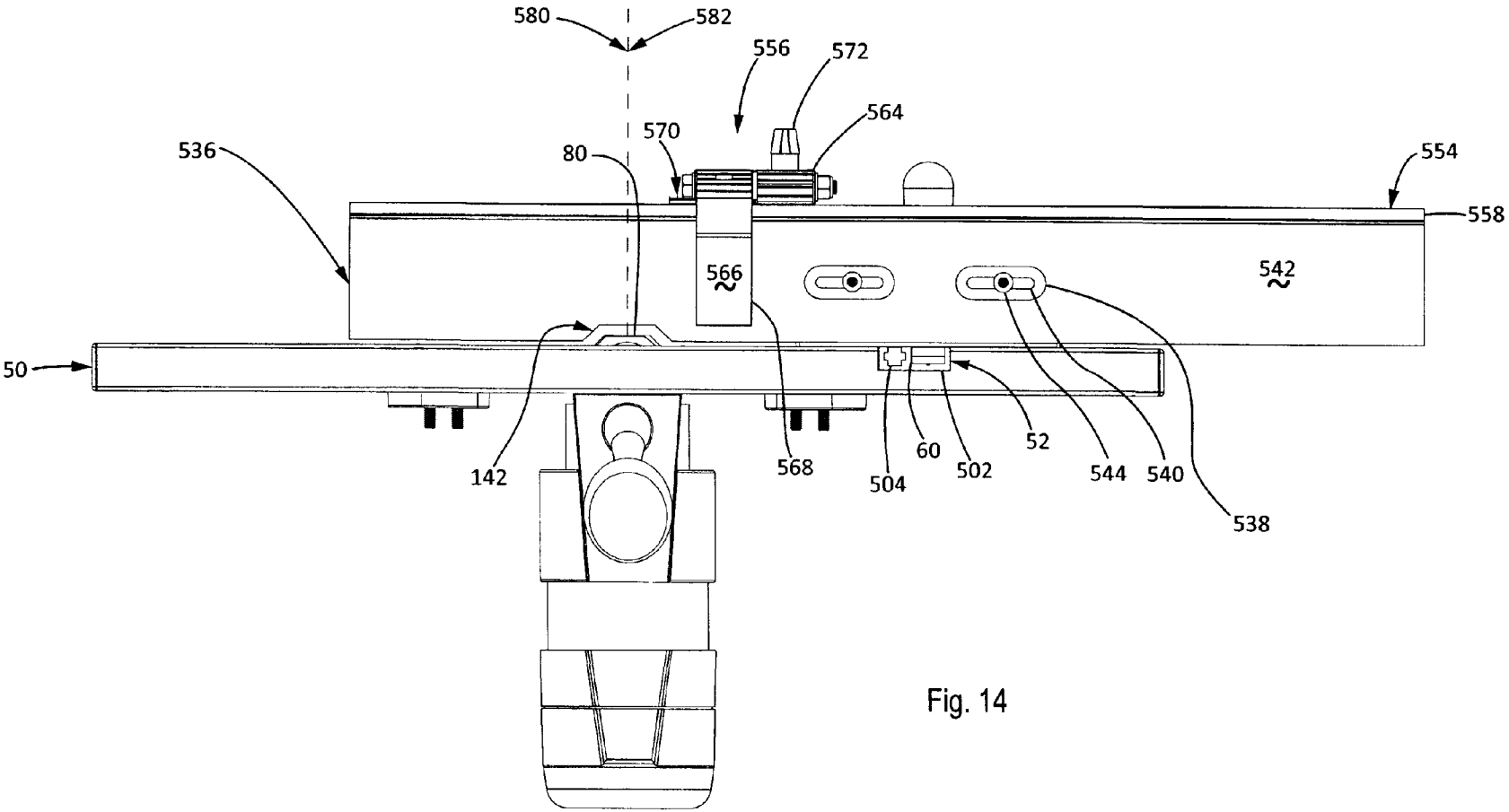
FIG. 14 is a side view of a modified machinery fence support system.
Figure 15:
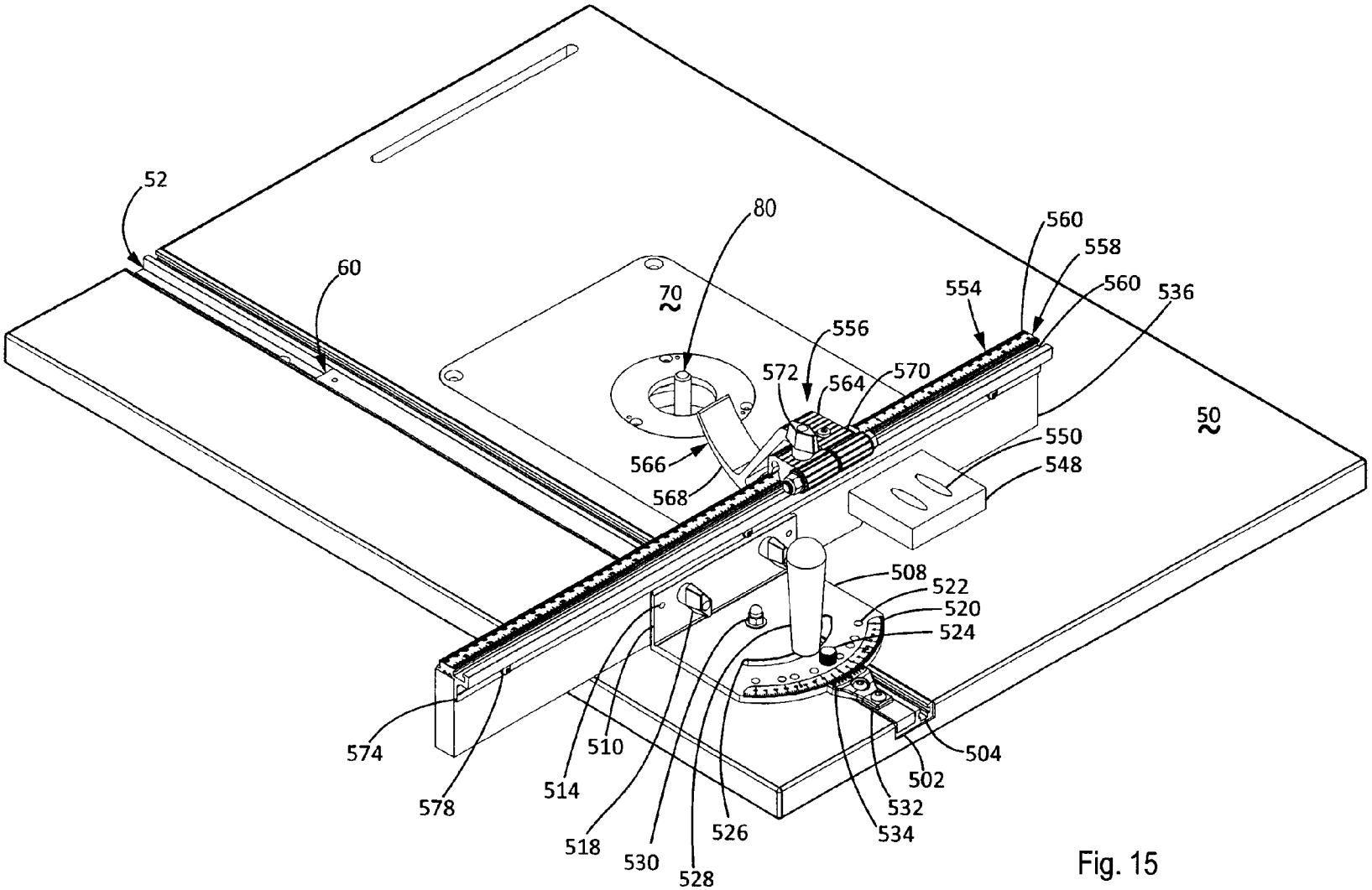
FIG. 15 is a perspective view of a modified machinery fence support system.
Figure 16:
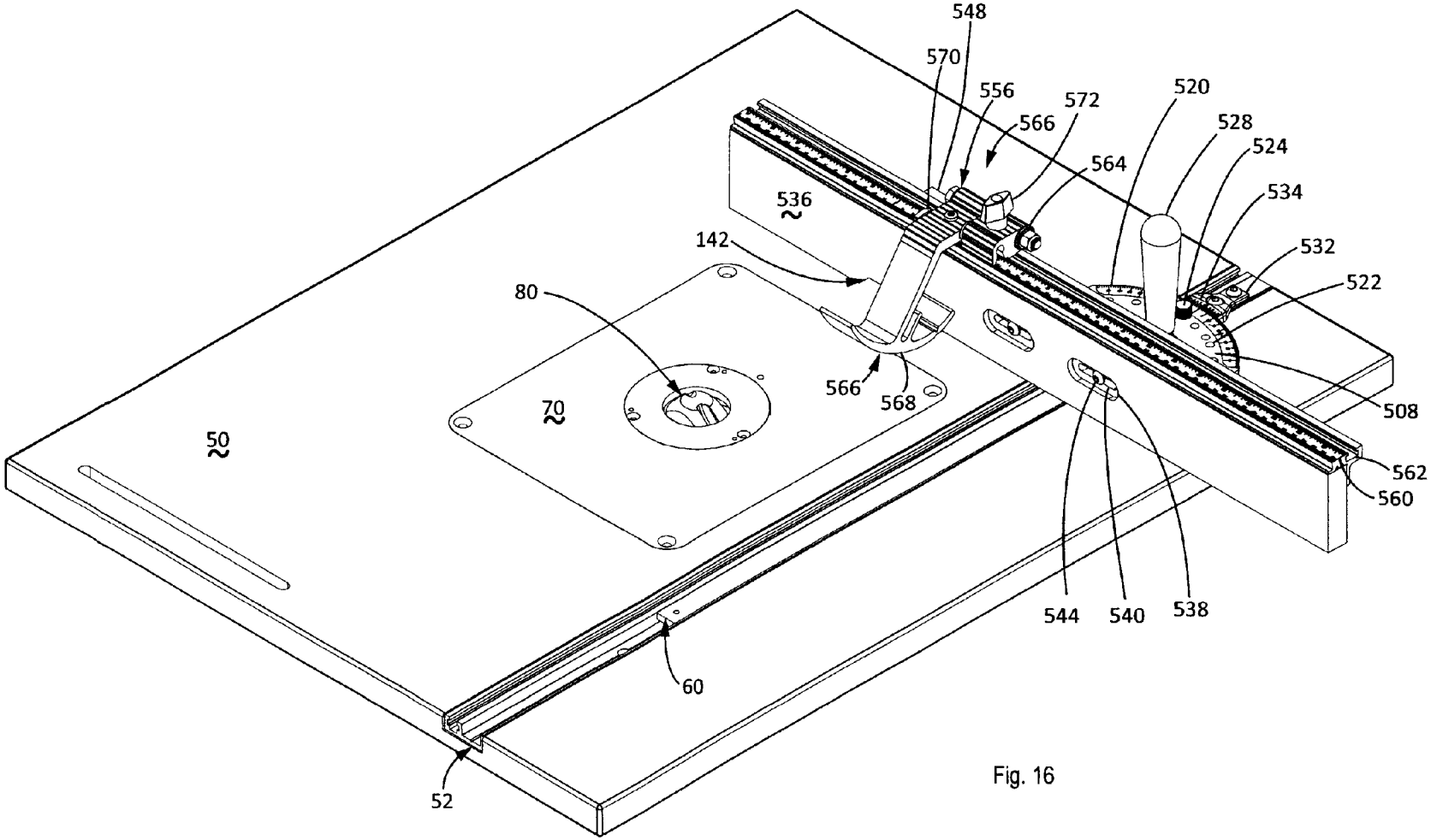
FIG. 16 is a perspective view of a modified machinery fence support system.
Figure 17:
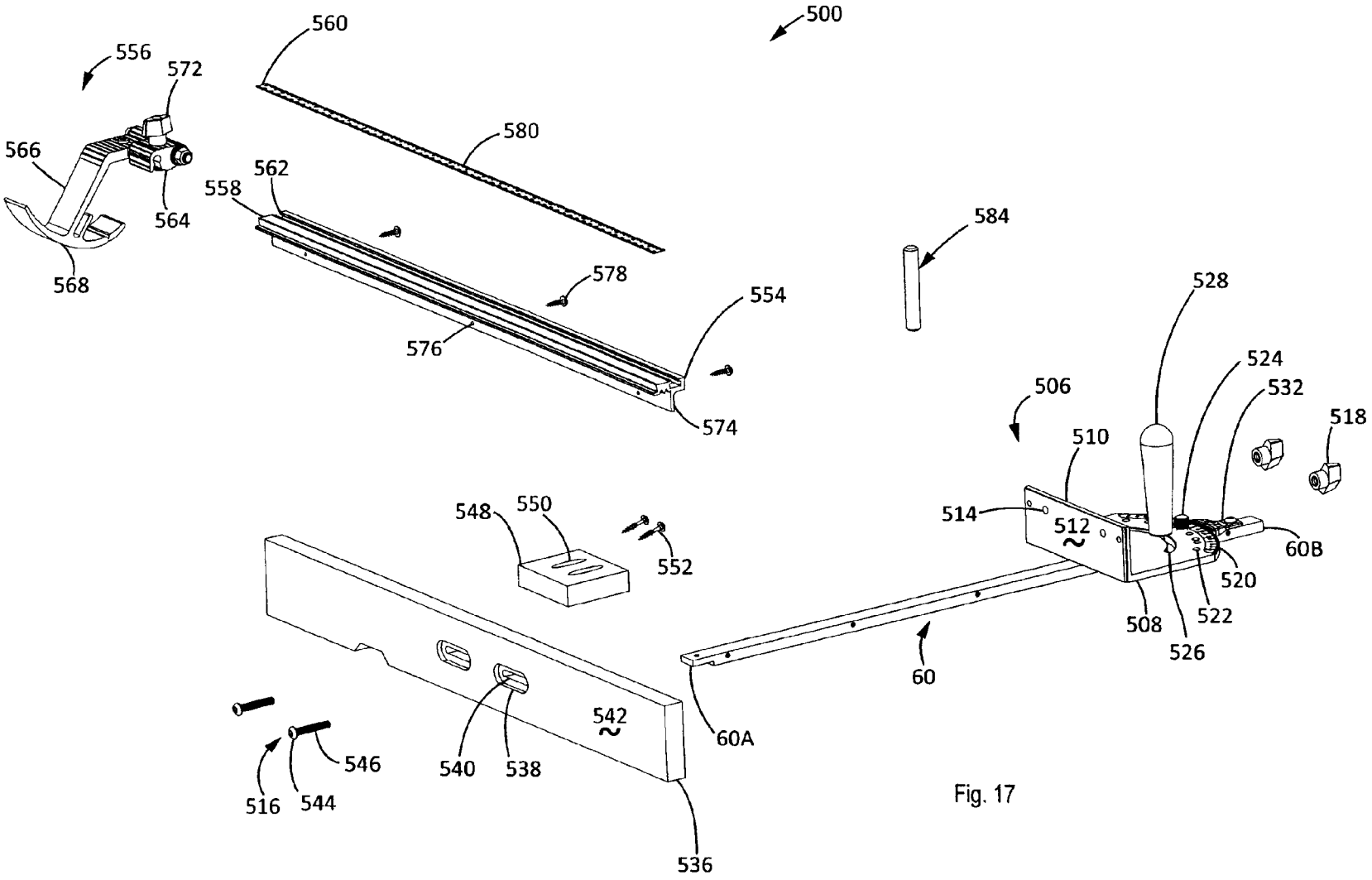
FIG. 17 is an exploded view of a modified machinery fence support system.
Figure 18A:
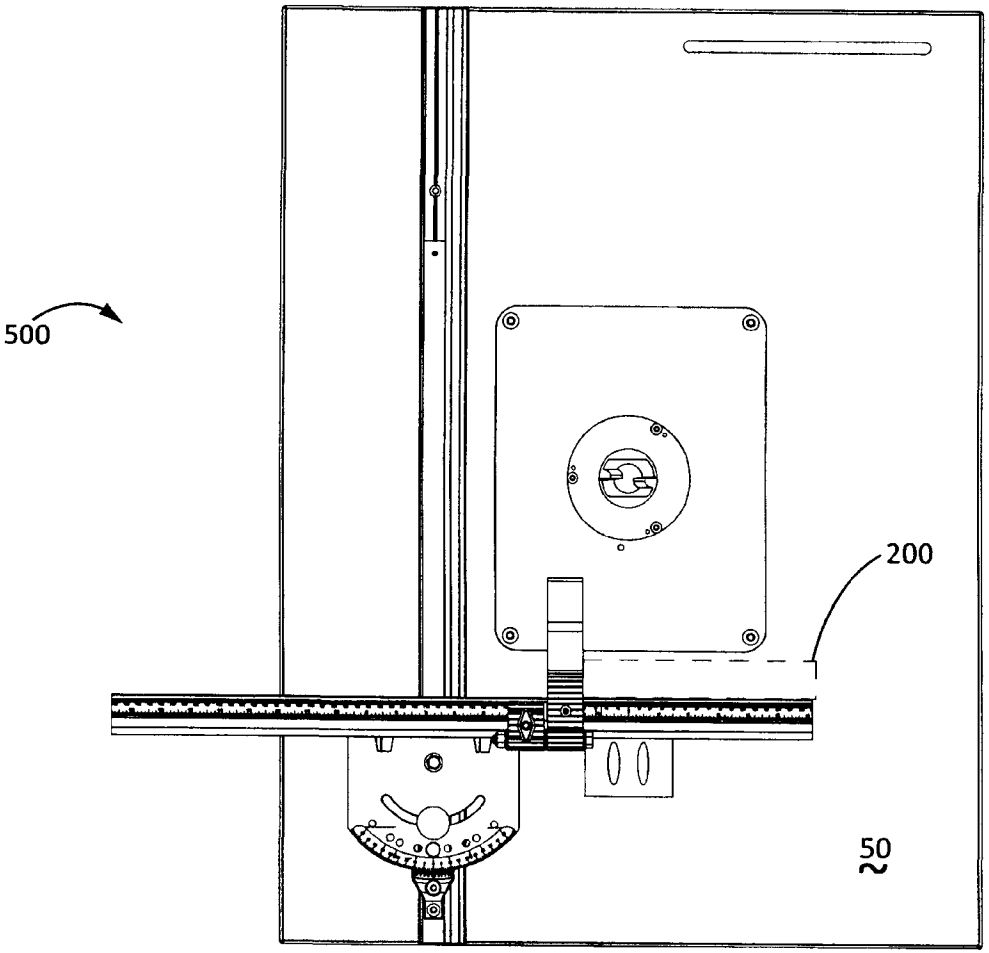
FIG. 18A is a top and side view of a modified machinery fence support system in a position prior to cutting a notch.
Figure 18B:
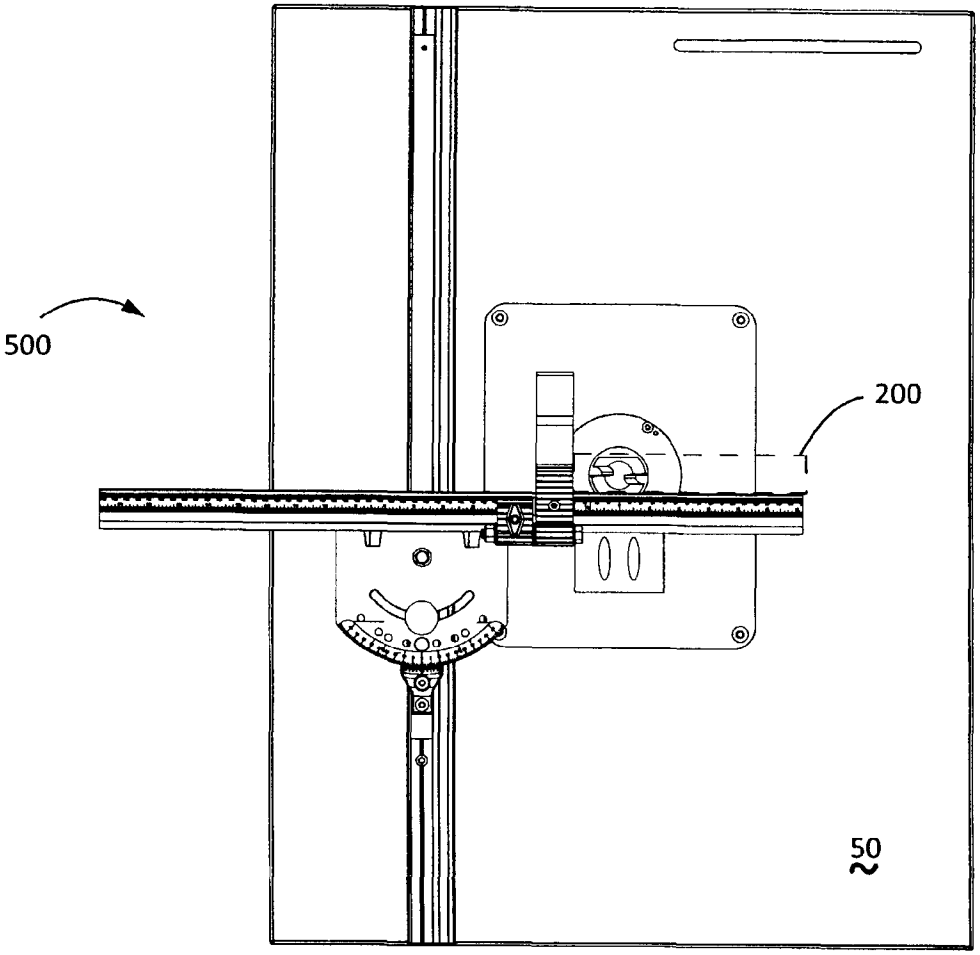
FIG. 18B is a top and side view of a modified machinery fence support system in a position where a notch is cut.
Figure 18C:
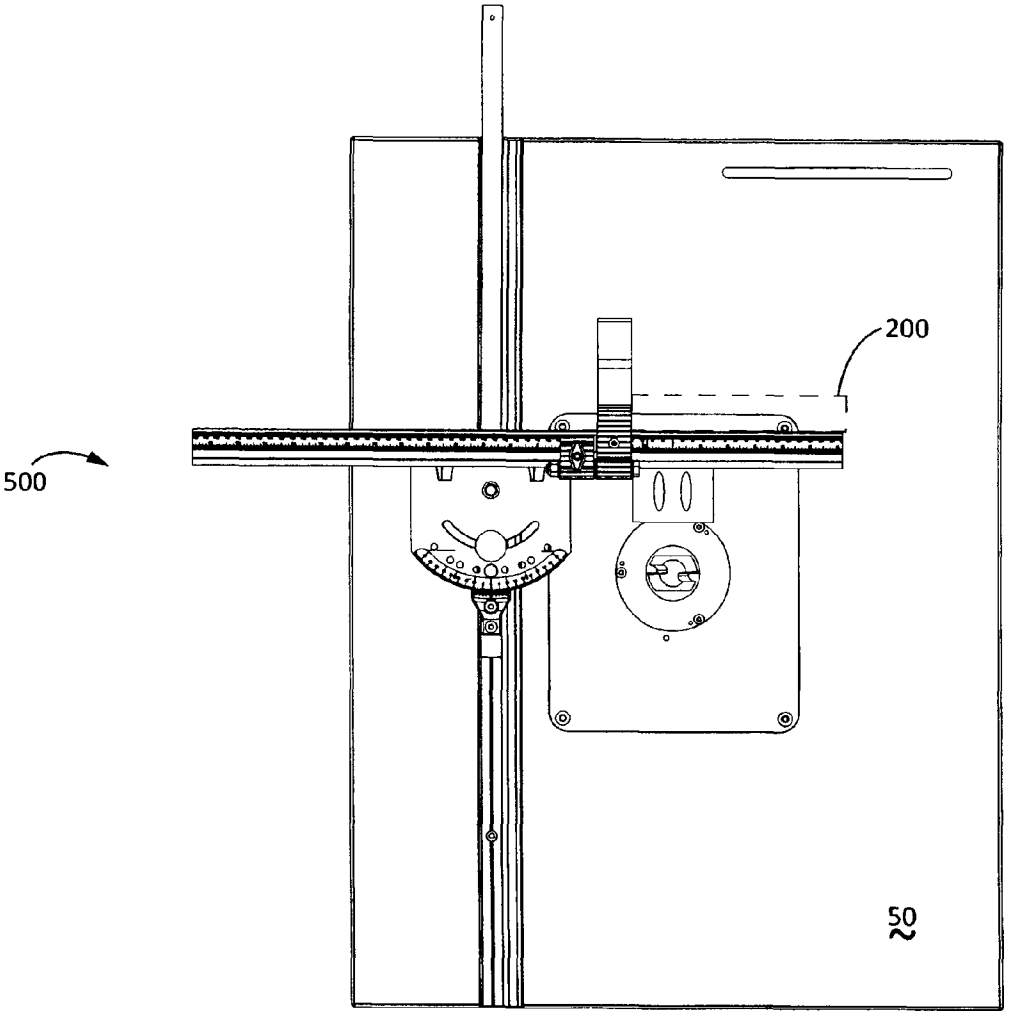
FIG. 18C is a top and side view of a modified machinery fence support system in a position after a notch is cut.

FIG. 10 illustrates router bit 400. Router bit 400 is suitable for cutting beaded features along an edge of a workpiece. For example, router bit 400 may be used to cut the beaded features of center rail 302, top and bottom rails 306 and stiles 304 (FIG. 9). 10047] Router bit 400 includes shaft 482, ball bearing guide 485 and cutting element 484. Cutting element 484 includes a cutting edge 486, which provides the profile of beaded features for workpieces of a beaded face frame.

Cutting edge 486 has a height 487. Height 487 may be configured to match height 87 of rotary bit 80, which facilitates simple positioning of rotary bit 80 relative to a beaded workpiece cut by router bit 400. As an example, height 487 may be between 0 and 2 inches. As other examples, height 487 may be approximately 0.125 inches, 0.25 inches, 0.375 inches, 0.5 inches, 0.75 inches, 1.0 inch, 1.5 inches, 2.0 inches or another height.

It can be particularly useful for height 487 to be a precise nominal value, such as 0.250 inches. For example, providing router bit 400 with a precise nominal height 487 of 0.250 inches facilitates the production of workpieces having beaded features with nominal widths of 0.250 inches. For rotary bit 80 (FIG. 4), the length 38 of distal side 81 should be precisely the width of a workpiece minus twice the width of a beaded feature of the workpiece. If length 38 is to have a nominal value, than the beaded features of a workpiece should also have precise nominal widths. For example, if a width of a workpiece is 1.500 inches, and the workpiece includes beaded features with widths of 0.250 inches, than length 38 of rotary bit 80 should be 1.000 inches. In such an example, rotary bit 80 may also be used for workpieces having widths greater than 1.500 inches by using two or more cutting motions.

In order to simply the production of beaded face frames, a rotary bit, such as rotary bit 80 may be included in a kit with a router bit suitable for cutting beaded features along an edge of a workpiece, such as router bit 400. Optionally, the kit may also include a machinery fence support facilitating fence movement in a direction perpendicular to a length of the fence. In such a kit, height 487 of router bit 400 may be substantially equal to height 87 of rotary bit 80. In addition, length 38 of rotary bit 80 may correspond to a standard nominal workpiece width, minus twice of height 487.

Other kit configurations may also be used. For example, a single rotary bit 80 may be included with a plurality of router bits configured to cut beaded features of different widths, e.g., 0.125 inches, 0.250 inches, 0.375 inches, 0.500 inches, 0.625 inches, 0.750 inches, 1.000 inches etc. In such an example, height 87 of rotary bit 80 should be at least as large as the height of the largest router bit. Prior to a cutting operation to form a notch, such as notch 340 (FIG. 8), rotary bit 80 should be set to a height that is substantially the same as the width of the beaded features of the workpiece. By using router bits with precise nominal heights to cut beaded features with precise nominal widths, the proper positioning of rotary bit 80 relative to a workpiece can be easily determined, especially when cutting a notch requires using two or more cuts, i.e., when the notch is to be wider than rotary bit 80.

In an alternative embodiment, with reference to FIGS. 11-18C, a modified machinery fence support system 500 is presented. The modified machinery fence support system 500 is supported by and engages worktable 50 which has a recess 52 therein. Recess 52 has a first rectangular recess 502 and a second t-shaped or cross-shaped recess 504 which extend across the length of the top surface of worktable 50. Worktable 50 has a removable insert plate 70 therein having a centrally located opening which surrounds cutting bit 80 which protrudes above the top surface of worktable 50. Connected to worktable 50 is router motor 505 which, when powered, rotates cutting bit 80 to perform a cutting operation.

Modified machinery fence support system 500 has a track 60. When viewed from the side, track 60 has a rectangular cross section or profile which corresponds to the first rectangular recess 502 of recess 52 such that track 60 fits within first rectangular recess 502 and matingly and frictionally engages and slides within first rectangular recess 502. To facilitate proper sliding, track 60 longitudinally extends a length between its forward end 60A and its rearward end 60B. The length of track 60 provides alignment and directional guidance to modified machinery fence support system 500 when sliding through recess 52. To provide proper guidance and alignment, preferably the length of track 60 is at least one half the length of worktable 50 and/or recess 52. Preferably, track 60 is made of a single solid extension or extrusion of metal which provides for inexpensive manufacture, durability and, as most worktables 50 are made of metal, the metal on metal engagement between recess 52 and track 60 provides for easy and controllable sliding. Alternatively, track 60 is made of any other material such as plastic, composite, wood, Fiberglass, ceramic or the like. Also, so as to improve sliding of track 60 additional mechanical attributes such as cutouts, ball bearings or the like are added to track 60.

Connected to track 60 is miter gage 506. Miter gage 506 allows for angular adjustability of modified machinery fence support system 500. Miter gage 506 has a base plate 508 having a forward end 508A and a rearward end 508B. Preferably base plate 508 is a flat piece of metal. Alternatively, base plate 508 takes on any other shape known in the art. Alternatively instead of miter gauge 506 a bracket that is not angularly adjustable is used in place of miter gage 506 so as to reduce cost, reduce moving parts and to improve rigidity of the device.

Connected to the forward end 508A of miter gage 506 and extending upwardly therefrom is connecting member 510. Preferably base plate 508 and connecting member 510 are made of a single flat piece of metal which is perpendicularly bent, or bent at a 90 degree angle, at the interface between base plate 508 and connecting member 510. Alternatively, base plate 508 and connecting member 510 are made of any other material such as composite, plastic, fiberglass or the like and are formed together through any other manufacturing method such as welding, casting, injection molding or the like. Connecting member 510 has a forward face 512 which is preferably flat. Preferably, forward face 512 of connecting member 510 is in perpendicular alignment and extends upwardly relative to the plane of worktable 50. Connecting member 510 also has at least a pair of apertures 514 which receive bolts 516 which are held in place and tightened by wing nuts 518.

The rearward end of miter gage 506 is preferably rounded or has a C-shape so as to facilitate angular adjustment. The top surface of this rearward edge has angular indicia 520 thereon so as to identify the angular position of miter gage 506 relative to length of track 60. Angular indicia 520 is imprinted within the base plate 508 such as through indentations, pressing, scribing or the like, or alternatively, angular indicia 520 is printed onto a sticker or the like which is then attached to the top surface of base plate 508 at its rearward end 508B.

Spaced inwardly from the C-shaped rearward end 508B of base plate 508 is a plurality of apertures 522 which are arranged at predetermined angular positions such as 0°, +/−15°, +/−30°, +/−45°, +/−60°, +/−75°, +/−90°, or any other preferred and often used angular position. These apertures 522 are aligned in a C-shaped pattern which mimic the shape and alignment of the rearward end 508B of base plate 508. Removably and replaceably positioned within the centrally positioned aperture 522 is set pin 524 which passes through the desired aperture 522 and engages the top surface of track 60 thereby locking miter gage 506 in the desired angular position. Set pin 524 has a locking mechanism, such as a threaded shaft which engages a threaded recess in track 60, spring mechanism which engages a recess in track 60, or the like mechanical arrangement, which loosens and tightens against or engages track 60 thereby allowing for the adjustment and locking of miter gage 506 at any predetermined angular position.

Spaced inwardly from apertures 522 is C-shaped slot 526. C-shaped slot 526 mimics the shape and alignment of the rearward end 508B of base plate 508 and apertures 522.

Passing through C-shaped slot 526 is handle 528. The upper portion of handle 528 is a comfortable gripping handle of any arrangement, style or shape as is known in the art, which is used to control and push modified machinery fence support system 500 forward and backward within recess 52 to perform a cutting operation. The lower end of handle 528 engages track 60. Preferably the lower end of handle 528 has a locking mechanism, such as a threaded shaft, spring mechanism as described above, or the like, which loosens and tightens against or engages track 60 thereby allowing for the adjustment and locking of miter gage 506 at any angular position. The C-shape or C-shaped slot 526 allows for handle 528 to remain positioned in the middle of track 60 regardless of the angle of miter gage 506.

Spaced forward or inwardly from C-shaped slot 526 is pivot pin 530. Pivot pin 530 extends upwardly from track 60, through base plate 508 and is then connected to a cap or nut thereby holding miter gage 506 to track 60. Pivot pin 530 is preferably located at the center or the center of mass of miter gage 506 and the center of the C-shaped slot 526 and apertures 522. Pivot pin 530 facilitates the angular rotation of miter gage 506 relative to track 60.

Connected to track 60, rearward of and adjacent to the rearward edge 508B of miter gage 506 is indicator 532. Indicator 532 extends upwardly from track 60 to engage or interface with angular indicia 520 to inform the user of the angle at which miter gage 506 is set. To facilitate this indication, indicator 532 preferably has a needle, indicia, line or the like indicia 534 to accurately inform the user of the angle at which miter gage 506 is set. In addition a magnifying lens or the like extends over the rearward end 508B of base plate 508 to more accurately inform the user of the angle at which miter gage 506 is set. Preferably, indicator 532 is screwed, bolted, welded or connected to track 60 by any means known in the art. Alternatively, indicator 532 is formed within or machined into track 60 as a single piece.

Connected to the forward face 512 of connecting member 510 is sacrificial fence 536. The flat and perpendicular nature of forward face 512 of connecting member 510 facilitates proper connection and alignment of sacrificial fence 536 to miter gage 506 and worktable 50. Sacrificial fence 536 is preferably a board of any nature such as a solid piece of lumber, a piece of press board, a piece of ply wood, a piece of composite material or the like, which is destroyed or consumed over time through use by way of engaging cutting element 84. To facilitate the connection of sacrificial fence 536 to connecting member 510 a pair of longitudinal grooves 538 and longitudinal slots 540 are cut into the forward face 542 of sacrificial fence 536. Longitudinal grooves 538 are sized to receive heads 544 of bolts 516 such that heads 544 move freely and do not protrude past the flat plane of forward face 542 of sacrificial fence 536. Longitudinal slots 540 are sized to allow shafts 546 of bolts 516 to pass therethrough while not allowing head 544 to pass therethrough. In this way, longitudinal grooves and slots 538, 540 allow for the lateral adjustment and tightening of sacrificial fence 536 relative to miter gage 506.

Positioned within the bottom edge of sacrificial fence 536 is recess 142. Recess 142 is cut into or through the bottom edge of sacrificial fence 536 by way of passing sacrificial fence 536 over cutting element 84. In this way, use of the device consumes, over time, sacrificial fence 536. However, the use of a common board for sacrificial fence 536 reduces the cost of the device. In addition using a sacrificial fence 536 made of wood reduces the potential for damage to the device or injury in the event of accidental contact between sacrificial fence 536 and cutting element 84 as compared to using a metallic steel, iron or aluminum fence 140.

Connected to the back surface of sacrificial fence 536 is guard 548. Guard 548 is centrally aligned and positioned above recess 142. Guard 548 extends rearward from sacrificial fence 536 a given distance. Guard 548 is preferably sized to extend laterally and rearwardly at least 1.5 times the diameter of cutting element 84 and well beyond the outward edges of recess 142. In this way, guard 548 acts to protect a user from incidental or accidental contact with cutting element 84 when pushing modified machinery fence support system 500 over and past cutting element 84. In addition, by longitudinally over sizing guard 548 to extend past the edges of recess 148, this provides an additional degree of protection in the event of misaligning cutting element 84 relative to recess 142. By laterally oversizing guard 548, this protects the user from contact with cutting element 84 in the event the user pushes sacrificial fence 536 well past cutting element 84. Preferably guard 548 is connected to sacrificial fence 536 by way of using at least two Kreg® pocket holes 550 and associated screws 552. Alternatively, guard 548 is connected to sacrificial fence 536 by any means known in the art such as screwing, bolting, gluing or the like. For added protection, guard 548 has arms which extend downwardly on either side of guard 548.

Removably and replaceably connected to the top surface of sacrificial fence 536 is a Kreg Top Track System™ 554 and flip stop assembly 556. One example of a Kreg Top Track System™ is represented by U.S. Pat. No. 5,337,641 to Duginske, incorporated by reference herein. Other examples include U.S. Pat. No. 5,617,909 to Duginske; U.S. Pat. No. 6,880,442 to Duginske; and U.S. Pat. No. 7,464,737 to Duginske all of which are incorporated by reference herein. Top track system 554 includes a rail 558 which is positioned on the top surface of sacrificial fence 536 and extends the length of sacrificial fence 536. Rail 558 has measuring indicia or a tape measure 560 on its top surface. Measuring indicia 560 is imprinted within the rail 558 such as through indentations, pressing, scribing or the like, or alternatively measuring indicia 560 is printed onto a sticker or tape which is then attached to the top surface of rail 558 by any means known in the art such as gluing, adhesive tape or the like.

The top surface of rail 558 also has an alignment channel 562 positioned adjacent to and rearwardly of measuring indicia 560. Alignment channel 562 runs the length rail 558 and preferably has a t-shaped or cross-shaped cross section. Slidably and adjustably mounted within alignment channel 562 is flip stop assembly 556 as is more fully shown and described in U.S. Pat. No. 6,880,442 to Duginske incorporated by reference herein.

Flip stop assembly 556 has a mounting base 564 which connects to and slidably adjusts within alignment channel 562. Mounting base 564 extends above rail 558 and over measuring indicia 560. Rotatably connected to mounting base 564 is curved flip stop arm 566 which has flat sides 568. Curved flip stop arm 566 is rotatably adjustable between a first position which engages workpiece 200 in front of sacrificial fence 536 and rail 558; and a second position wherein the flip stop arm 566 is out of the way and does not engage a workpiece 200. Connected to mounting base 564 and extending outwardly therefrom is alignment lens 570. As mounting base 564 extends above measuring indicia 560, alignment lens 570, which has a magnifying portion, is used to indicate the precise location of the flip stop assembly 556 relative to measuring indicia 560. To facilitate this indication, alignment lens 570 preferably has a needle, indicia, line or the like to accurately inform the user of the position of flip stop assembly 556. Flip stop assembly 556 also has a thumb screw 572 which passes through the flip stop assembly 556 and engages rail 558 so as to lock flip stop assembly 556 in place once in the desired location.

Extending outwardly and downwardly from the bottom surface of rail 558 is connecting flange 574. Preferably the forward surface of flange 574 is flat, as is the bottom surface of rail 558. Rail 558 and flange 574 preferably connect to form a 90 degree angle or perpendicular interface so as to accommodate standard square boards which may be used as a sacrificial fence 536. Flange 574 has a plurality of apertures 576 positioned therein so as to allow screws 578 to pass therethrough thereby removably and replaceably attaching top track system 554 to a replaceable sacrificial fence 536.

In operation, a user assembles the modified machinery fence support system 500 by first selecting an appropriate board to serve as a sacrificial fence 536. Next, the longitudinal grooves 538 and longitudinal slots 540 are cut in the forward face 542 of sacrificial fence 536. Once slots and grooves 540, 542 are cut, top track system 554 is installed on sacrificial fence 536.

To install the top track system 554 on the sacrificial board 536 the bottom surface of rail 558 is placed on the top surface of sacrificial board 536 with the forward surface of connecting flange 574 engaging the back surface of sacrificial board 536. Once in this alignment, screws 578 are placed in each aperture 576 and tightened in place. Thereby frictionally holding top track system 554 on sacrificial fence 536.

Next flip stop assembly 556 is installed on the top track system 554 by connecting mounting base 564 to alignment channel 562. Once in the appropriate location, mounting base 564 is locked in place by tightening thumb screw 572 against rail 558.

Next, guard 548 is installed. First a suitable board is selected to serve as a guard 548 which is long enough in the longitudinal and lateral directions to provide adequate protection, that is, guard 548 should at least be wider and longer then the diameter of cutting surface 84, or 1.5 times the diameter of cutting surface 84. A pair of Kreg™ pocket holes 550 are cut into guard 548 and the guard 548 is positioned on the back side of sacrificial fence 536 at the appropriate location. Guard 548 is vertically spaced above the general position where cutting element 84 shall pass. Preferably guard 548 is centered on the zero position 580 of the top track section 554. Screws 552 are then inserted in each Kreg™ pocket hole 550 thereby connecting guard 548 to sacrificial fence 536 at and above the zero position 580.

Once fully constructed, sacrificial fence 536 is attached to miter gage 506 by placing the back side of sacrificial fence 536 in flush alignment with forward face 512 of connecting member 510. The longitudinal grooves and slots 538, 540 are aligned with apertures 514 in connecting member 510. Once in this alignment bolts 516 are passed through sacrificial fence 536 and apertures 514. Sacrificial fence 536 is then tightened in place against connecting member 510 by tightening wing nuts 518 on bolts 516.

Next, miter gage 506 is installed on track 60 by passing pivot pin 530 through the appropriate aperture in base plate 508 and tightening pivot pin 530. Next, handle 528 is installed in C-shaped slot 526 and engaged into track 60. Similarly set pin 524 is installed in a centrally located aperture 522 and engaged into track 60.

With the modified machinery fence support system 500 fully assembled, track 60 is positioned within first rectangular recess 502 of recess 52 thereby allowing for the forward and back sliding of the modified machinery fence support system 500 relative to worktable 50 so as to perform a cutting operation.

To adjust the modified machinery fence support system 500 to cut beaded face frame features, sacrificial fence 536 is aligned at 0 degrees, or perpendicular to the length of track 60. Next, the zero-position 580 of measuring indicia 560 is centered on the axis of rotation 582 of router motor 505 or rotary bit 80 by loosening wing nuts 518 and sliding the sacrificial fence 536 within longitudinal grooves and slots 538, 540 until the zero-point 580 aligns with the axis of rotation 582. Once in place, wing nuts 518 are tightened.

An improved method of centering the zero-position 580 sacrificial fence 536 on the axis of rotation 582 is to use a pin 584. If pin 584 has a radius of ¼ inch, the flip stop assembly 556 is adjusted to the ¼ inch position from the zero-position 582. Once in this position, the wingnuts 518 are tightened within longitudinal slots and grooves 538, 540. In this way, the sacrificial fence 536 is zeroed on the zero-position 582 without the need to measure or guess.

To cut full notches 340 and partial notches 330, flip stop assembly 556 is positioned at the appropriate location on rail 558 and thumb screw 572 is tightened against rail 558. Flip stop arm 566 is then rotated in front of sacrificial fence 536 and workpiece 200 is placed flush with the front surface of sacrificial fence 536 and flush with the flat side surface 568 of flip stop arm 566. Once in this position, a user clamps the workpiece to the sacrificial fence 536 so as to hold the workpiece in place. Once in this position, the user turns on router motor 505, grips handle 528 and slides modified machinery fence support system 500 within recess 52 until workpiece 200 completely passes over cutting element 84 thereby cutting a notch 330, 340. (See FIGS. 18A, 18B, 18C). Once the workpiece passes cutting element 84, cutting element 84 passes into recess 142 in sacrificial fence 536. Once the sacrificial fence 536 passes through recess 142, cutting element 84 is covered by guard 548.

In this way all of the stated objectives are achieved. Various examples of this disclosure have been described. These and other examples are within the scope of the following claims.

The invention claimed is:

1. A method of using a machinery fence support system comprising the steps of:

connecting a stop assembly to a track assembly;

connecting the track assembly to a sacrificial fence;

connecting the sacrificial fence to a bracket;

connecting the bracket to a track;

placing the track in a recess which extends a length of a worktable having a top surface and a cutting element extending above the top surface of the worktable;

placing a workpiece in engagement with the stop assembly and the sacrificial fence; and sliding the track within the recess such that the workpiece passes over the cutting element to form a beaded face frame feature.

2. The method of using a machinery fence support system of claim 1 wherein the workpiece slides in a direction parallel to the length of the recess.

3. The method of using a machinery fence support system of claim 1 wherein the machinery fence support system slides in a direction parallel to the length of the recess.

4. The method of using a machinery fence support system of claim 1 wherein when the workpiece passes over the cutting element a notch is cut in the workpiece for a beaded face frame.

5. A method of using a machinery fence support system comprising the steps of:

obtaining a worktable having a recess therein and a cutting element protruding through the worktable;

placing a machinery fence system on the worktable wherein the fence system has a track connected to a fence;

inserting the track of the machinery fence system into the recess of the worktable; and sliding the machinery fence system along the recess such that the fence passes over the cutting element thereby cutting a beaded face frame feature.

6. The method of claim 5 wherein the track and the fence are positioned in a generally perpendicular manner to one another.

7. The method of claim 5 further comprising the step of setting an adjustable stop connected to the fence by placing a pin in the position of the cutting element and aligning an edge of the stop with an edge of the pin.

8. The method of claim 7 wherein the adjustable stop is set to a position equal to the radius of the pin.

* * * * *